US010607615B2

(12) United States Patent
Paulus et al.

(10) Patent No.: US 10,607,615 B2
(45) Date of Patent: Mar. 31, 2020

(54) APPARATUS AND METHOD FOR DECODING AN ENCODED AUDIO SIGNAL TO OBTAIN MODIFIED OUTPUT SIGNALS

(71) Applicant: Fraunhofer-Gesellschaft zur Foerderung der angewandten Forschung e.V., Munich (DE)

(72) Inventors: Jouni Paulus, Erlangen (DE); Leon Terentiv, Erlangen (DE); Harald Fuchs, Roettenbach (DE); Oliver Hellmuth, Erlangen (DE); Adrian Murtaza, Craiova (RO); Falko Ridderbusch, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/002,334

(22) Filed: Jan. 20, 2016

(65) Prior Publication Data

US 2016/0140968 A1 May 19, 2016

Related U.S. Application Data

(63) Continuation of application No. PCT/EP2014/065533, filed on Jul. 18, 2014.

(30) Foreign Application Priority Data

Jul. 22, 2013 (EP) ..... 13177379

(51) Int. Cl.

| | |
|---|---|
| ***H04R 5/00*** | (2006.01) |
| ***G10L 19/008*** | (2013.01) |
| ***H04S 3/02*** | (2006.01) |

(52) U.S. Cl.
CPC ..... *G10L 19/008* (2013.01); *H04S 3/02* (2013.01); *H04S 2400/01* (2013.01); *H04S 2400/03* (2013.01); *H04S 2420/03* (2013.01)

(58) Field of Classification Search
CPC ..... G10L 19/008; H04S 3/02; H04S 2400/01; H04S 2400/03; H04S 2420/03
(Continued)

(56) References Cited

U.S. PATENT DOCUMENTS 8,116,459 B2 * 2/2012 Disch ..... H04S 3/002 381/10
9,190,065 B2 * 11/2015 Sen ..... G10L 19/008
(Continued)

FOREIGN PATENT DOCUMENTS

CN 101542596 A 9/2009
CN 102171751 A 8/2011
(Continued)

OTHER PUBLICATIONS

Engdegard, J et al., "Spatial Audio Object Coding (SAOC)—The Upcoming MPEG Standard on Parametric Object Based Audio Coding", Audio Engineering Society, *Convention Paper*, presented at the 124th Convention, May 17-20, 2008, pp. 1-15.
(Continued)

*Primary Examiner* — Xu Mei
(74) *Attorney, Agent, or Firm* — Michael A. Glenn; Perkins Coie LLP

(57) ABSTRACT

An apparatus for decoding an encoded audio signal to obtain modified output signals includes an input interface for receiving a transmitted downmix signal and parametric data relating to audio objects included in the transmitted downmix signal, the downmix signal being different from an encoder downmix signal, to which the parametric data is related; a downmix modifier for modifying the transmitted
(Continued)

downmix signal using a downmix modification function, wherein the downmix modification is performed in such a way that a modified downmix signal is identical to the encoder downmix signal or is more similar to the encoder downmix signal compared to the transmitted downmix signal; an object renderer for rendering the audio objects using the modified downmix signal and the parametric data to obtain output signals; and an output signal modifier for modifying the output signals using an output signal modification function.

12 Claims, 9 Drawing Sheets

(58) Field of Classification Search
USPC ..... 381/22, 23
See application file for complete search history.

(56) References Cited

U.S. PATENT DOCUMENTS

| | | | | |
|---|---|---|---|---|
| 2011/0022402 | A1 | 1/2011 | Engdegard et al. | |
| 2011/0106529 | A1 | 5/2011 | Disch et al. | |
| 2011/0166867 | A1* | 7/2011 | Seo | G10L 19/008 704/500 |
| 2011/0200197 | A1* | 8/2011 | Kim | G10L 19/008 704/500 |
| 2014/0050325 | A1* | 2/2014 | Norris | G10L 19/008 381/23 |

FOREIGN PATENT DOCUMENTS

| | | | |
|---|---|---|---|
| CN | 102460571 | A | 5/2012 |
| EP | 2320415 | A1 | 5/2011 |
| JP | 2007-531916 | A | 11/2007 |
| JP | 2010-508545 | A | 3/2010 |
| KR | 1020090057131 | A | 6/2009 |
| KR | 20100008755 | A | 1/2010 |
| RU | 2417459 | C2 | 4/2011 |
| WO | 2008100100 | A1 | 8/2008 |

OTHER PUBLICATIONS

Engdegard, J et al., "Spatial Audio Object Coding (SAOC)—The Upcoming MPEG Standard on Parametric Object Based Audio Coding", Audio Engineering Society, *Convention Paper* 7377 presented at the 124th Convention, May 17-20, 2008, pp. 1-15.

Faller, C. et al., "Binaural Cue Coding—Part II: Schemes and Applications", IEEE Transactions on Speech and Audio Processing, vol. 11, No. 6, Nov. 2003, pp. 520-531.

Faller, C., "Parametric Joint-Coding of Audio Sources", AES Convention Paper 6752, Presented at the 120th Convention, Paris, France, May 20-23, 2006, 12 pages.

Girin, L. et al., "Informed audio source separation from compressed linear stereo mixtures", AES 42nd International Conference: Semantic Audio, <hal-00695724>, Jul. 2011, pp. 159-168.

Herre, J. et al., "From SAC to SAOC—Recent Developments in Parametric Coding of Spatial Audio", Fraunhofer Institute for Integrated Circuits, Illusions in Sound, AES 22nd UK Conference 2007, Apr. 2007, pp. 12-1 through 12-8.

ISO/IEC, "MPEG audio technologies—Part 2: Spatial Audio Object Coding (SAOC)", ISO/IEC JTC1/SC29/WG11 (MPEG) International Standard 23003-2, pp. 1-130.

Liutkus, A et al., "Informed source separation through spectrogram coding and data embedding", 2011 IEEE Workshop on Applications of Signal Processing to Audio and Acoustics, Oct. 16-19, 2011, 4 pages.

Ozerov, A. et al., "Informed source separation: source coding meets source separation", IEEE Workshop on Applications of Signal Processing to Audio and Acoustics, 2011, 4 pages.

Parvaix, M et al., "A Watermarking-Based Method for Informed Source Separation of Audio Signals with a Single Sensor", IEEE Transactions on Audio, Speech and Language Processing, vol. 18, No. 6, Aug. 2010, pp. 1464-1475.

Parvaix, M et al., "Informed source separation of underdetermined instantaneous stereo mixtures using source index embedding", IEEE International Conference on Acoustics, Speech, and Signal Processing (ICASSP 2010) <hal-00486804>, May 26, 2010, pp. 245-248.

Zhang, S. et al., "An informed source separation system for speech signals", 12th Annual Conference of the International Speech Communication Association (Interspeech 2011), Aug. 17, 2011, pp. 573-576.

EBU-Recommendation R 128, "Loudness normalisation and permitted maximum level of audio signals", Aug. 2011, pp. 3-5.

* cited by examiner

A block diagram of the operation of an SAOC decoder including the compensation of the downmix signal manipulations before the main SAOC processing and including the modification recovery module after the rendering.

$$X = g(X_{postprocessed}) = W_{PDG} X_{postprocessed} = \begin{pmatrix} PDG_1 & \cdots & 0 \\ \vdots & \ddots & \vdots \\ 0 & \cdots & PDG_M \end{pmatrix} X_{postprocessed}$$

$$h(X) = g^{-1}(X) = W_{PDG}^{-1} X = \begin{pmatrix} 1/PDG_1 & \cdots & 0 \\ \vdots & \ddots & \vdots \\ 0 & \cdots & 1/PDG_M \end{pmatrix} X$$

$$W_{PDG}^{-1} = \begin{pmatrix} 1/PDG_1 + \varepsilon) & \cdots & 0 \\ \vdots & \ddots & \vdots \\ 0 & \cdots & 1/PDG_M + \varepsilon) \end{pmatrix}$$

$$W_{PDG}^{-1} = \begin{pmatrix} 1/\max(PDG_1, \varepsilon) & \cdots & 0 \\ \vdots & \ddots & \vdots \\ 0 & \cdots & 1/\max(PDG_M, \varepsilon) \end{pmatrix}$$

FIG 3

A basic block diagram of the operation of an SAOC system.

A block diagram of the operation of an SAOC decoder.

A block diagram of the operation of an SAOC system including a modification of the downmix signal.

A block diagram of the operation of an SAOC system including a modification of the downmix signal and a path to the SAOC encoder from the modified downmix.

A block diagram of the operation of an SAOC decoder including the compensation of the downmix signal modifications before the main SAOC processing.

APPARATUS AND METHOD FOR DECODING AN ENCODED AUDIO SIGNAL TO OBTAIN MODIFIED OUTPUT SIGNALS

CROSS-REFERENCE TO RELATED APPLICATIONS

This application is a continuation of copending International Application No. PCT/EP2014/065533, filed Jul. 18, 2014, which claims priority from European Application No. EP 13177379.8, filed Jul. 22, 2013, which are each incorporated herein in its entirety by this reference thereto.

The present invention is related to audio object coding and particularly to audio object coding using a mastered downmix as the transport channel.

BACKGROUND OF THE INVENTION

Recently, parametric techniques for the bitrate-efficient transmission/storage of audio scenes containing multiple audio objects have been proposed in the field of audio coding [BCC, JSC, SAOC, SAOC1, SAOC2] and informed source separation [ISS1, ISS2, ISS3, ISS4, ISS5, ISS6]. These techniques aim at reconstructing a desired output audio scene or audio source object based on additional side information describing the transmitted/stored audio scene and/or source objects in the audio scene. This reconstruction takes place in the decoder using a parametric informed source separation scheme.

Here, we will focus mainly on the operation of the MPEG Spatial Audio Object Coding (SAOC) [SAOC], but the same principles hold also for other systems. The main operations of an SAOC system are illustrated in FIG. 5. Without loss of generality, in order to improve readability of equations, for all introduced variables the indices denoting time and frequency dependency are omitted in this document, unless otherwise stated. The system receives N input audio objects $S_1, \ldots, S_N$ and instructions how these objects should be mixed, e.g., in the form of a downmixing matrix D. The input objects can be represented as a matrix S of size $N \times N_{Samples}$. The encoder extracts parametric and possibly also waveform-based side information describing the objects. In SAOC the side information consists mainly from the relative object energy information parameterized with Object Level Differences (OLDS) and from information of the correlations between the objects parameterized with Inter-Object Correlations (IOCs). The optional waveform-based side information in SAOC describes the reconstruction error of the parametric model. In addition to extracting this side information, the encoder provides a downmix signal $X_1, \ldots, X_M$ with M channels, created using the information within the downmixing matrix D of size $M \times N$. The downmix signals can be represented as a matrix X of size $M \times N_{Samples}$ with the following relationship to the input objects: $X=DS$. Normally, the relationship $M<N$ holds, but this is not a strict requirement. The downmix signals and the side information are transmitted or stored, e.g., with the help of an audio codec such as MPEG-2/4 AAC. The SAOC decoder receives the downmix signals and the side information, and additional rendering information often in the form of a rendering matrix M of size $K \times N$ describing how the output $Y_1, \ldots, Y_K$ with K channels is related to the original input objects.

The main operational blocks of an SAOC decoder are depicted in FIG. 6 and will be briefly discussed in the following. First, the side information is decoded and interpreted appropriately. The (Virtual) Object Separation block uses the side information and attempts to (virtually) reconstruct the input audio objects. The operation is referred to with the notion of "virtual" as usually it is not necessary to explicitly reconstruct the objects, but the following rendering stage can be combined with this step. The (virtual) object reconstructions $\hat{S}_1, \ldots, \hat{S}_N$ may still contain reconstruction errors. The (virtual) object reconstructions can be represented as a matrix $\hat{S}$ of size $N \times N_{Samples}$. The system receives the rendering information from outside, e.g., from user interaction. In the context of SAOC, the rendering information is described as a rendering matrix M defining the way the object reconstructions $\hat{S}_1, \ldots, \hat{S}_N$ should be combined to produce the output signals $Y_1, \ldots Y_K$. The output signals can be represented as a matrix Y of size $K \times N_{Samples}$ being the result of applying the rendering matrix M on the reconstructed objects $\hat{S}$ through $Y=M\hat{S}$.

The (virtual) object separation in SAOC operates mainly by using parametric side information for determining unmixing coefficients, which it then will apply on the downmix signals for obtaining the (virtual) object reconstructions. Note, that the perceptual quality obtained this way may be lacking for some applications. For this reason, SAOC provides also an enhanced quality mode for up to four original input audio objects. These objects, referred to as Enhanced Audio Objects (EAOs), are associated with time-domain correction signals minimizing the difference between the (virtual) object reconstructions and the original input audio objects. An EAO can be reconstructed with very small waveform differences from the original input audio object.

One main property of an SAOC system is that the downmix signals $X_1, \ldots, X_M$ can be designed in such a way that they can be listened to and they form a semantically meaningful audio scene. This allows the users without a receiver capable of decoding the SAOC information to still enjoy the main audio content without the possible SAOC enhancements. For example, it would be possible to apply an SAOC system as described above within radio or TV broadcast in a backward compatible way. It would be practically impossible to exchange all the receivers deployed only for adding some non-critical functionality. The SAOC side information is normally rather compact and it can be embedded within the downmix signal transport stream. The legacy receivers simply ignore the SAOC side information and output the downmix signals, and the receivers including an SAOC decoder can decode the side information and provide some additional functionality.

However, especially in the broadcast use case, the downmix signal produced by the SAOC encoder will be further post-processed by the broadcast station for aesthetic or technical reasons before being transmitted. It is possible that the sound engineer would want to adjust the audio scene to fit better his artistic vision, or the signal is manipulated to match the trademark sound image of the broadcaster, or the signal should be manipulated to comply with some technical regulations, such as the recommendations and regulations regarding the audio loudness. When the downmix signal is manipulated, the signal flow diagram of FIG. 5 is changed into the one seen in FIG. 7. Here, it is assumed that the original downmix manipulation of downmix mastering applies some function $f(\bullet)$ on each of the downmix signals $X_i$, $1 \le i \le M$, resulting to the manipulated downmix signals $f(X_i)$, $1 \le i \le M$. It is also possible that the actually transmitted downmix signals are not stemming from the ones produced by the SAOC encoder, but are provided from outside as a whole, but this situation is included in the discussion as being also a manipulation of the encoder-created downmix.

The manipulation of the downmix signals may cause problems in the SAOC decoder in the (virtual) object separation as the downmix signals in the decoder may not necessarily anymore match the model transmitted through the side information. Especially when the waveform side information of the prediction error is transmitted for the EAOs, it is very sensitive towards waveform alterations in the downmix signals.

It should be noted, that the MPEG SAOC [SAOC] is defined for the maximum of two downmix signals and one or two output signals, i.e., $1 \leq M \leq 2$ and $1 \leq K \leq 2$ However, the dimensions are here extended to a general case, as this extension is rather trivial and helps the description.

It has been proposed in [PDG, SAOC] to route the manipulated downmix signals also to the SAOC encoder, extract some additional side information, and use this side information in the decoder to reduce the differences between the downmix signals complying with the SAOC mixing model and the manipulated downmix signals available in the decoder. The basic idea of the routing is illustrated in FIG. 8*a* with the additional feedback connection from the downmix manipulation into the SAOC encoder. The current MPEG standard for SAOC [SAOC] includes parts of the proposal [PDG] mainly focusing on the parametric compensation. The estimation of the compensation parameters is not described here, but the reader is referred to the informative Annex D.8 of the MPEG SAOC standard [SAOC].

The correction side information is packed into the side information stream and transmitted and/or stored alongside. The SAOC decoder decodes the side information and uses the downmix modification side information to compensate for the manipulations before the main SAOC processing. This is illustrated in FIG. 8*b*. The MPEG SAOC standard defines the compensation side information to consist of gain factors for each downmix signal. These are denoted with $PDG_i$ wherein $1 \leq i \leq M$ is the downmix signal index. The individual signal parameters can be collected into a matrix $$W_{PDG} = \begin{pmatrix} PDG_1 & \dots & 0 \\ \vdots & \ddots & \vdots \\ 0 & \dots & PDG_M \end{pmatrix}.$$

When the manipulated downmix signals are denoted with the matrix $X_{postprocessed}$, the compensated downmix signals to be used in the main SAOC processing can be obtained with $X = WX_{postprocessed}$.

In [PDG] it is also proposed to include waveform residual signals describing the difference between the parametrically compensated manipulated downmix signals and the downmix signals created by the SAOC encoder. These, however, are not a part of the MPEG SAOC standard [SAOC].

The benefit of the compensation is that the downmix signals received by the SAOC (virtual) object separation block are closer to the downmix signals produced by the SAOC encoder and match the transmitted side information better. Often, this leads into reduced artifacts in the (virtual) object reconstructions.

The downmix signals used by the (virtual) object separation approximate the un-manipulated downmix signals created in the SAOC encoder. As a result, the output after the rendering will approximate the result that would be obtained by applying the often user-defined rendering instructions on the original input audio objects. If the rendering information is defined to be identical or very close to the downmixing information, in other words, $M \approx D$, the output signals will resemble the encoder-created downmix signals: $Y \approx X$. Remembering that the downmix signal manipulation may take place due to well-grounded reasons, it may be desirable that the output would resemble the manipulated downmix, instead, $Y \approx f(X)$.

Let us illustrate this with a more concrete example from the potential application of dialog enhancement in broadcast.

The original input audio objects S consist of a (possibly multi-channel) background signal, e.g., the audience and ambient noise in a sports broadcast, and a (possibly multi-channel) foreground signal, e.g., the commentator.

The downmix signal X contains a mixture of the background and the foreground.

The downmix signal is manipulated by $f(X)$ consisting in a real-word case of, e.g., a multiband equalizer, a dynamic range compressor, and a limiter (any manipulation done here is later referred to as "mastering").

In the decoder, the rendering information is similar to the downmixing information. The only difference is that the relative level balance between the background and the foreground signals can be adjusted by the end-user. In other words, the user can attenuate the audience noise to make the commentator more audible, e.g., for an improved intelligibility. As an opposite example, the end-user may attenuate the commentator to be able to focus more on the acoustic scene of the event.

If no compensation of the downmix manipulation is used, the (virtual) object reconstructions may contain artifacts caused by the differences between the real properties of the received downmix signals and the properties transmitted as the side information.

If compensation of the downmix manipulation is used, the output will have the mastering removed. Even in the case when the end-user does not modify the mixing balance, the default downmix signal (i.e., the output from receivers not capable of decoding the SAOC side information) and the rendered output will differ, possibly quite considerably.

In the end, the broadcaster has then the following sub-optimal options:

accept the SAOC artifacts from the mismatch between the downmix signals and the side information;

do not include any advanced dialog enhancement functionality; and/or lose the mastering alterations of the output signal.

SUMMARY

According to an embodiment, an apparatus for decoding an encoded audio signal to acquire modified output signals may have: an input interface for receiving a transmitted downmix signal and parametric data relating to audio objects included in the transmitted downmix signal, the transmitted downmix signal being different from an encoder downmix signal, to which the parametric data is related; a downmix modifier for modifying the transmitted downmix signal using a downmix modification function, wherein the downmix modification is performed in such a way that a modified downmix signal is identical to the encoder downmix signal or is more similar to the encoder downmix signal compared to the transmitted downmix signal; an object renderer for rendering the audio objects using the modified downmix signal and the parametric data to acquire output signals; and an output signal modifier for modifying the output signals using an output signal modification function, wherein the output signal modification function is such that a manipulation operation applied to the encoded downmix signal to acquire the transmitted downmix signal is at least partly applied to the output signals to acquire the modified output signals.

According to another embodiment, a method of decoding an encoded audio signal to acquire modified output signals may have the steps of: receiving a transmitted downmix signal and parametric data relating to audio objects included in the transmitted downmix signal, the transmitted downmix signal being different from an encoder downmix signal, to which the parametric data is related; modifying the transmitted downmix signal using a downmix modification function, wherein the downmix modification is performed in such a way that a modified downmix signal is identical to the encoder downmix signal or is more similar to the encoder downmix signal compared to the transmitted downmix signal; rendering the audio objects using the modified downmix signal and the parametric data to acquire output signals; and modifying the output signals using an output signal modification function, wherein the output signal modification function is such that a manipulation operation applied to the encoded downmix signal to acquire the transmitted downmix signal is at least partly applied to the output signals to acquire the modified output signals.

According to another embodiment, a computer-readable medium may have computer-readable code stored thereon to perform an inventive method, when the computer-readable medium is run by a computer or processor.

The present invention is based on the finding that an improved rendering concept using encoded audio object signals is obtained, when the downmix manipulations which have been applied within a mastering step are not simply discarded to improve object separation, but are then re-applied to the output signals generated by the rendering step. Thus, it is made sure that any artistic or other downmix manipulations are not simply lost in the case of audio object coded signals, but can be found in the final result of the decoding operation. To this end, the apparatus for decoding an encoded audio signal comprises an input interface, a subsequently connected downmix modifier for modifying the transmitted downmix signal using a downmix modification function, an object renderer for rendering the audio objects using the modified downmix signal and the parametric data and a final output signal modifier for modifying the output signals using an output signal modification function where the modification takes place in such a way that a modification by the downmix modification function is at least partly reversed or, stated differently, the downmix manipulation is recovered, but is not applied again to the downmix, but to the output signals of the object renderer. In other words, the output signal modification function is advantageously inverse to the downmix signal modification, or at least partly inverse to the downmix signal modification function. Stated differently, the output signal modification function is such that a manipulation operation applied to the original downmix signal to obtain the transmitted downmix signal is at least partly applied to the output signal and advantageously the identical operation is applied.

In advantageous embodiments of the present invention, both modification functions are different from each other and at least partly inverse to each other. In a further embodiment, the downmix modification function and the output signal modification function comprise respective gain factors for different time frames or frequency bands and either the downmix modification gain factors or the output signal modification gain factors are derived from each other. Thus, either the downmix signal modification gain factors or the output signal modification gain factors can be transmitted and the decoder is then in the position to derive the other factors from the transmitted ones, typically by inverting them.

Further embodiments include the downmix modification information in the transmitted signal as side information and the decoder extracts the side information, performs downmix modification on the one hand, calculates an inverse or at least partly or approximately inverse function and applies this function to the output signals from the object renderer.

Further embodiments comprise transmitting a control information to selectively activate/deactivate the output signal modifier in order to make sure that the output signal modification is only performed when it is due to an artistic reason while the output signal modification is, for example, not performed when it is due to pure technical reasons such as a signal manipulation in order to obtain better transmission characteristics for certain transmission format/modulation methods.

Further embodiments relate to an encoded signal, in which the downmix has been manipulated by performing a loudness optimization, an equalization, a multiband equalization, a dynamic range compression or a limiting operation and the output signal modifier is then configured to re-apply an equalization operation, a loudness optimization operation, a multiband equalization operation, a dynamic range compression operation or a limiting operation to the output signals.

Further embodiments comprise an object renderer which generates the output signals based on the transmitted parametric information and based on position information relating to the positioning of the audio objects in the replay setup. The generation of the output signals can be either done by recreating the individual object signals, by then optionally modifying the recreated object signals and by then distributing the optionally modified reconstructed objects to the channel signals for loudspeakers by any kind of well-known rendering concept such as vector based amplitude panning or so. Other embodiments do not rely on an explicit reconstruction of the virtual objects but perform a direct processing from the modified downmix signal to the loudspeaker signals without an explicit calculation of the reconstructed objects as it is known in the art of spatial audio coding such as MPEG-Surround or MPEG-SAOC.

In further embodiments, the input signal comprises regular audio objects and enhanced audio objects and the object renderer is configured for reconstructing audio objects or for directly generating the output channels using the regular audio objects and the enhanced audio objects.

BRIEF DESCRIPTION OF THE DRAWINGS

Embodiments of the present invention will be detailed subsequently referring to the appended drawings, in which:

FIG. 3 is illustrating a way to derive the output signal modification function from the downmix signal modification function;

DETAILED DESCRIPTION OF THE INVENTION

Figure 1:
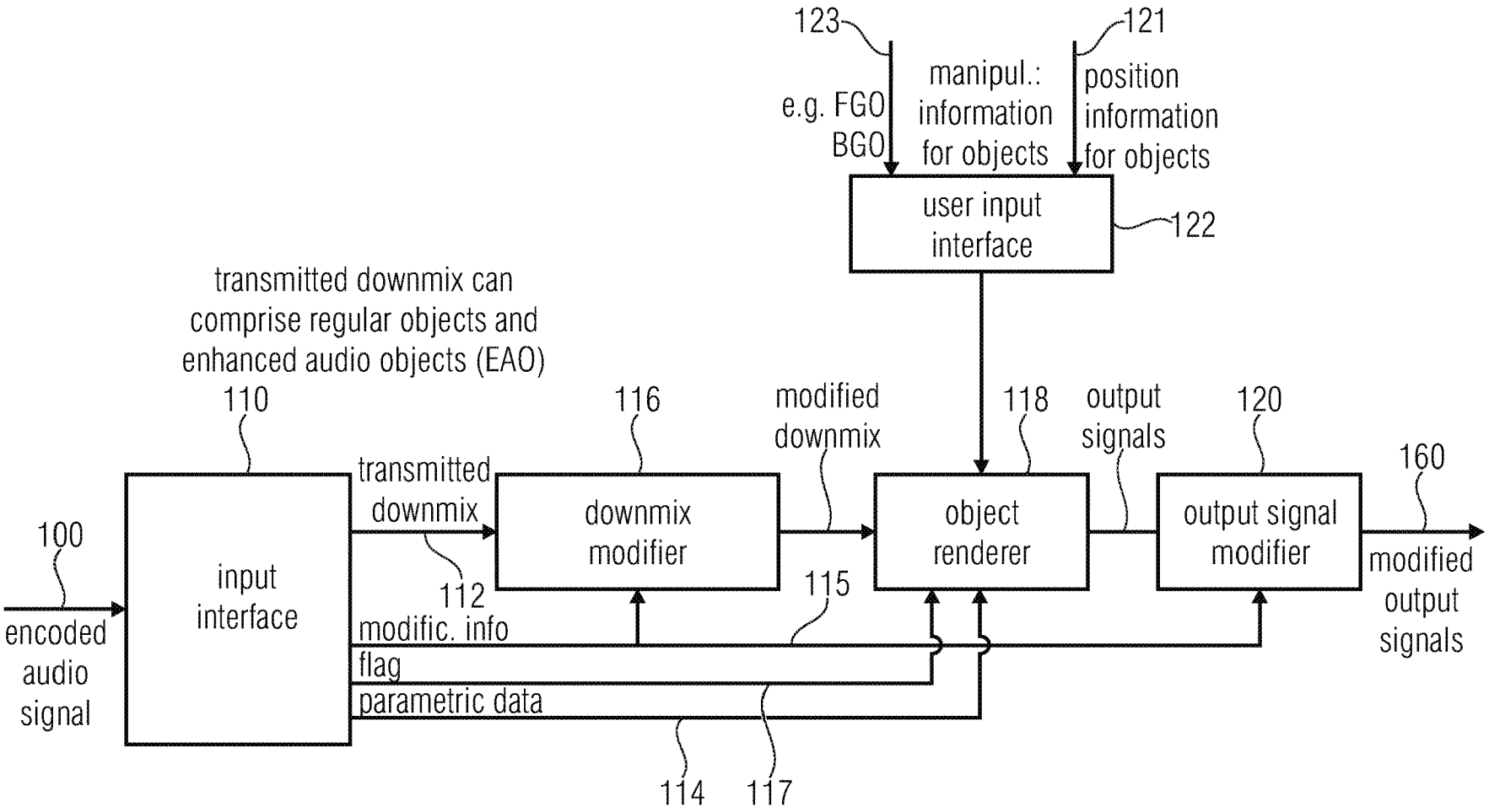
FIG. 1 is a block diagram of an embodiment of the audio decoder.
Figure 5:
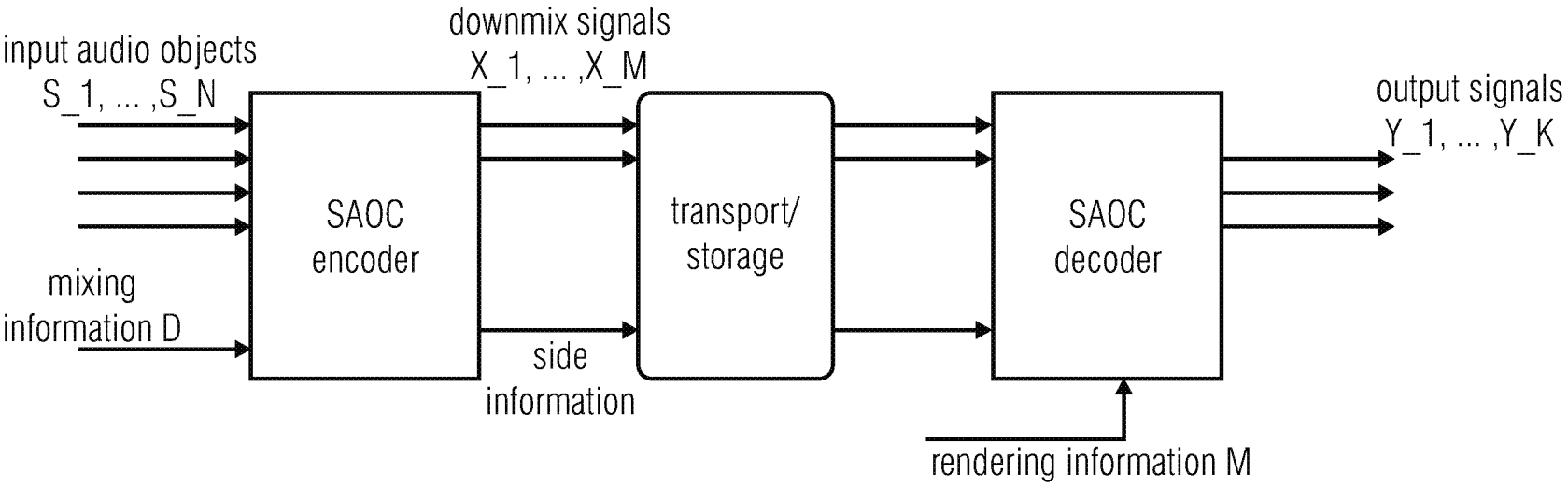
FIG 5 (PRIOR ART)
FIG. 5 illustrates a basic block diagram of an operation of an SAOC system.
Figure 6:
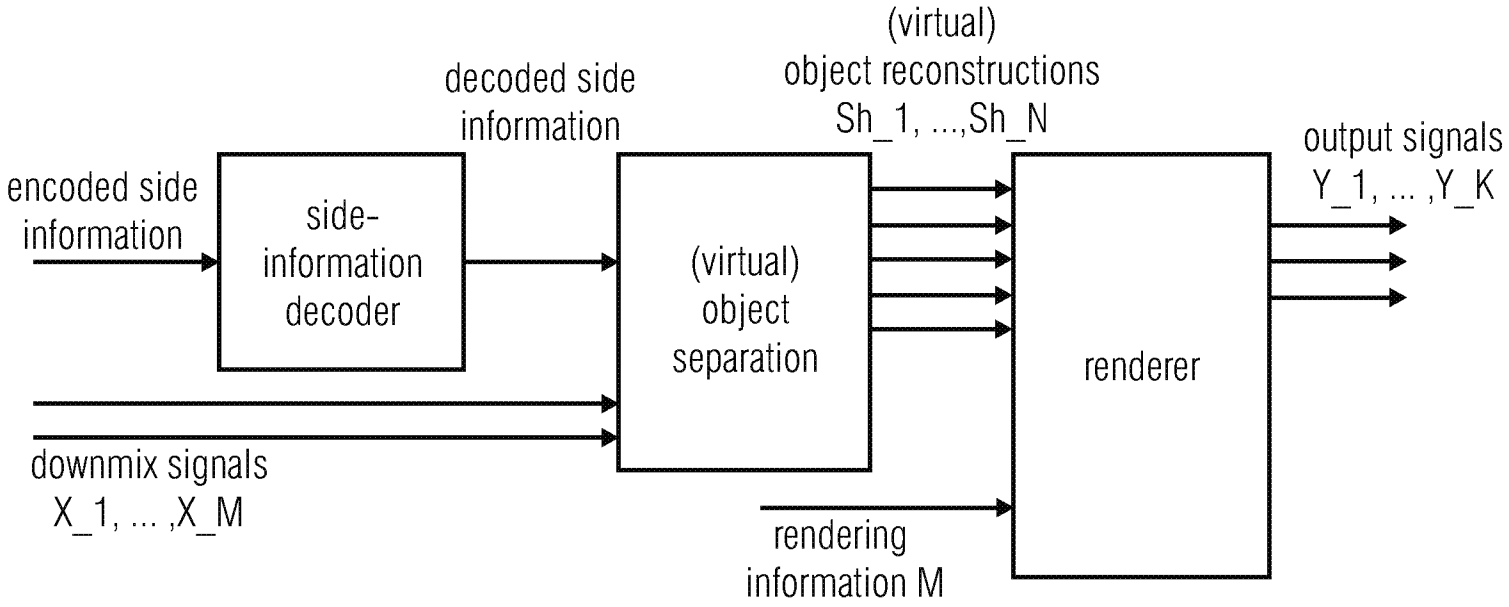
FIG 6 (PRIOR ART)
FIG. 6 illustrates a block diagram of the operation of an SAOC decoder.
Figure 7:
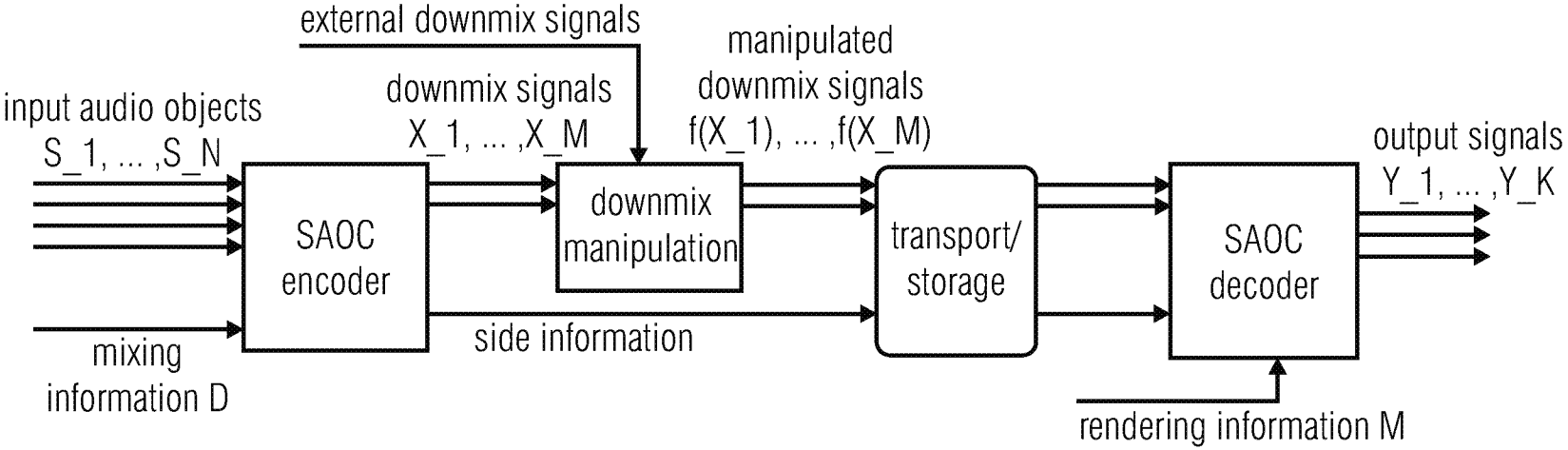
FIG 7 (PRIOR ART)
FIG. 7 illustrates a block diagram of the operation of an SAOC system including a manipulation of the downmix signal.
Figure 8A:
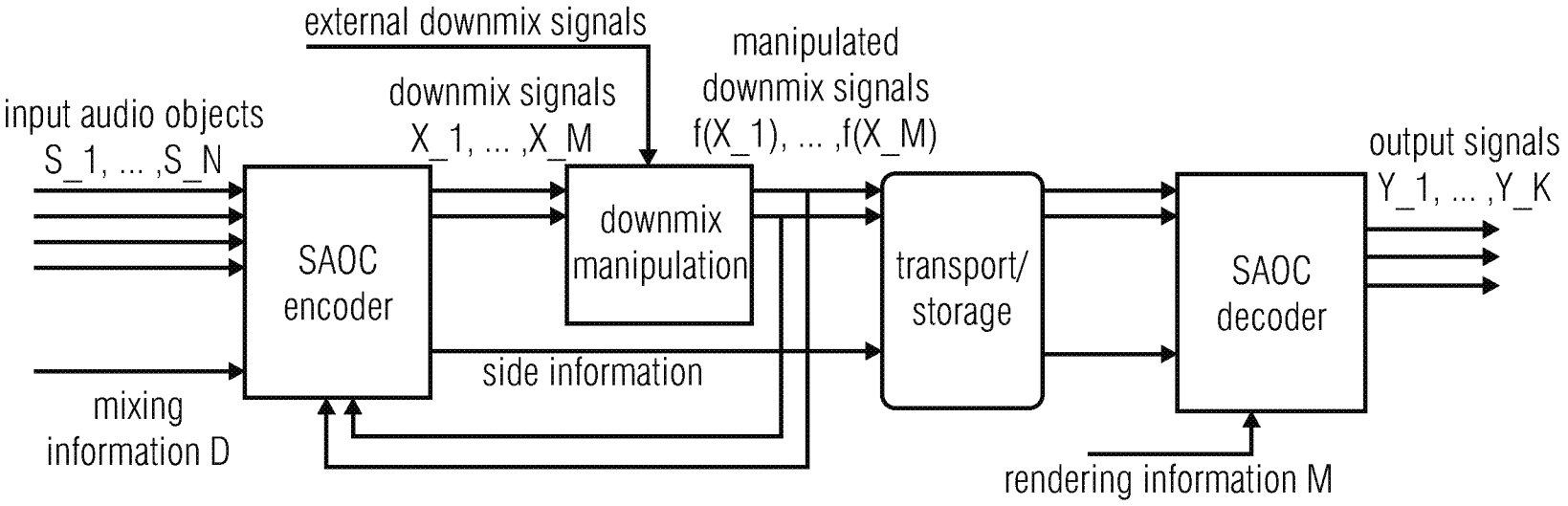
FIG 8A (PRIOR ART)
FIG. 8*a* illustrates a block diagram of the operation of an SAOC system including a manipulation of the downmix signal.

FIG. 1 illustrates an apparatus for decoding an encoded audio signal 100 to obtain modified output signals 160. The apparatus comprises an input interface 110 for receiving a transmitted downmix signal and parametric data relating to two audio objects included in the transmitted downmix signal. The input interface extracts the transmitted downmix signal 112, and the parametric data 114 from the encoded audio signal 100. In particular, the downmix signal 112, i.e., the transmitted downmix signal, is different from an encoder downmix signal, to which the parametric data 114 are related. Furthermore, the apparatus comprises a downmix modifier 116 for modifying the transmitted downmix signal 112 using a downmix modification function. The downmix modification is performed in such a way that a modified downmix signal is identical to the encoder downmix signal or is at least more similar to the encoder downmix signal compared to the transmitted downmix signal. Advantageously, the modified downmix signal at the output of block 116 is identical to the encoder downmix signal, to which the parametric data is related. However, the downmix modifier 116 can also be configured to not fully reverse the manipulation of the encoder downmix signal, but to only partly remove this manipulation. Thus, the modified downmix signal is at least more similar to the encoder downmix signal then the transmitted downmix signal. The similarity can, for example, be measured by calculating the squared distance between the individual samples either in the time domain or in the frequency domain where the differences are formed sample by sample, for example, between corresponding frames and/or bands of the modified downmix signal and the encoder downmix signal. Then, this squared distance measure, i.e., sum over all squared differences, is smaller than the corresponding sum of squared differences between the transmitted downmix signal 112 (generated by block downmix manipulation in FIG. 7 or 8*a*) and the encoder downmix signal (generated in block SAOC encoder in FIGS. 5, 6, 7. 8*a*.

Figure 8B:
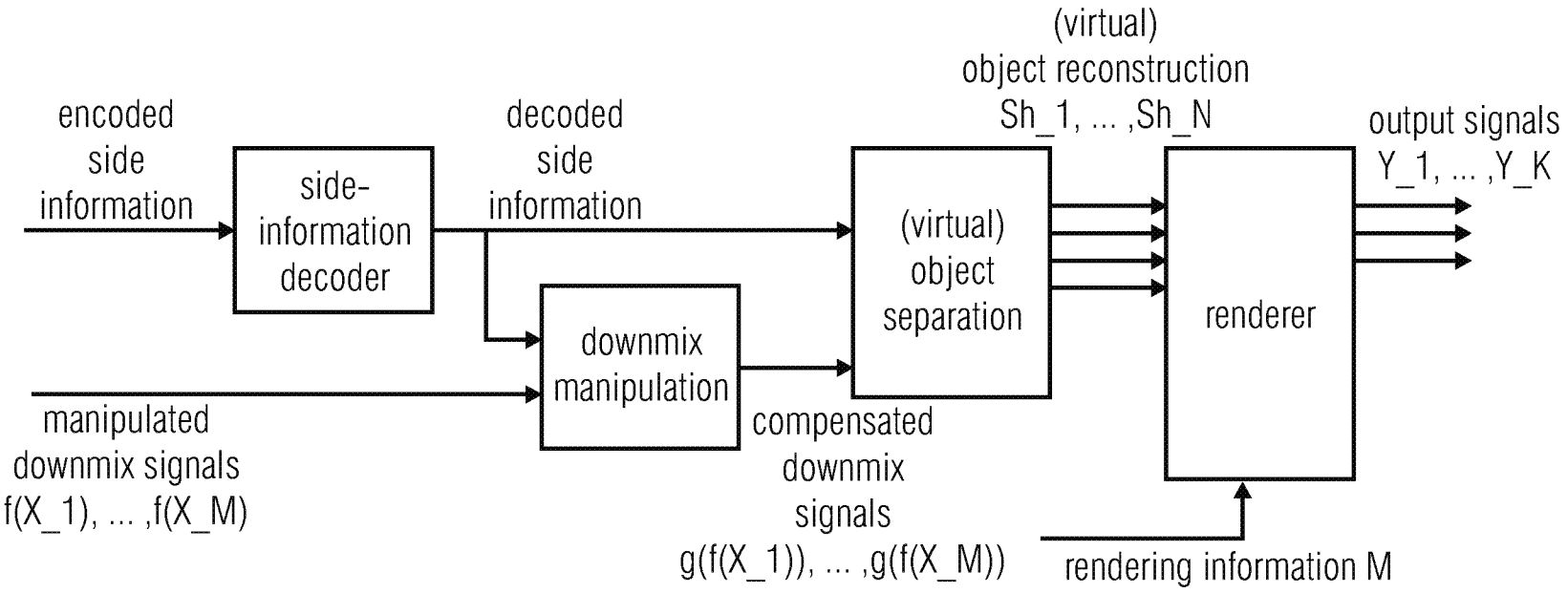
FIG 8B (PRIOR ART)
FIG. 8*b* illustrates a block diagram of the operation of an SAOC decoder including the compensation of the downmix signal manipulation before the main SAOC processing.

Thus, the downmix modifier 116 can be configured similarly to the downmix modification block as discussed on the context of FIG. 8*b*.

The apparatus in FIG. 1 furthermore comprises an object renderer 118 for rendering the audio objects using the modified downmix signal and the parameter data 114 to obtain output signals. Furthermore, the apparatus importantly comprises an output signal modifier 120 for modifying the output signals using an output signal modification function. Advantageously, the output modification is performed in such a way a modification applied by the downmix modifier 116 is at least partly reversed. In other embodiments, the output signal modification function is inversed or at least partly inversed to the downmix signal modification function. Thus, the output signal modifier is configured for modifying the output signals using the output signal modification function such that a manipulation operation applied to the encoder downmix signal to obtain the transmitted downmix signal is at least partly applied to the output signal and advantageously is fully applied to the output signals.

In an embodiment, the downmix modifier 116 and the output signal modifier 120 are configured in such a way that the output signal modification function is different from the downmix modification function and at least partly inversed to the downmix modification function.

Furthermore, an embodiment of the downmix modifier comprises a downmix modification function comprising applying downmix modification gain factors to different time frames or frequency bands of the transmitted downmix signal 112. Furthermore, the output signal modification function comprises applying output signal modification gain factors to different time frames or frequency bands of the output signals. Furthermore, the output signal modification gain factors are derived from inverse values of the downmix signal modification function. This scenario applies, when the downmix signal modification gain factors are available, for example by a separate input on the decoder side or are available because they have been transmitted in the encoded audio signal 100. However, alternative embodiments also comprise the situation that the output signal modification gain factors used by the output signal modifier 120 are transmitted or are input by the user and then the downmix modifier 116 is configured for deriving the downmix signal modification gain factors from the available output signal modification gain factors.

In a further embodiment, the input interface 110 is configured to additionally receive information on the downmix modification function and this modification information 115 is extracted by the input interface 110 from the encoded audio signal and provided to the downmix modifier 116 and the output signal modifier 120. Again, the downmix modification function may comprise downmix signal modification gain factors or output signal modification gain factors and depending on which set of gain factors is available, the corresponding element 116 or 120 then derives its gain factors from the available data.

In a further embodiment, an interpolation of downmix signal modification gain factors or output signal modification gain factors is performed. Alternatively or additionally, also a smoothing is performed so that situations, in which those transmit data change too rapidly do not introduce any artifacts.

In an embodiment, the output signal modifier 120 is configured for deriving its output signal modification gain factors by inverting the downmix modification gain factors. Then, in order to avoid numerical problems, either a maximum of the inverted downmix modification gain factor and a constant value or a sum of the inverted downmix modification gain factor and the same or a different constant value is used. Therefore, the output signal modification function does not necessarily have to be fully inverse to the downmix signal modification function, but is at least partly inverse.

Furthermore, the output signal modifier 120 is controllable by a control signal indicated at 117 as a control flag. Thus, the possibility exists that the output signal modifier 120 is selectively activated or deactivated for certain frequency bands and/or time frames. In an embodiment, the flag is just the 1-bit flag and when the control signal is so that the output signal modifier is deactivated, then this is signaled by, for example, a zero state of the flag and then the control signal is so that the output signal modifier is activated, then this is for example signaled by a one-state or set state of the flag. Naturally, the control rule can be vice versa.

In a further embodiment, the downmix modifier 116 is configured to reduce or cancel a loudness optimization or an equalization or a multiband equalization or a dynamic range compression or a limiting operation applied to the transmitted downmix channel. Stated differently, those operations have been applied typically on the encoder-side by the downmix manipulation block in FIG. 7 or the downmix manipulation block in FIG. 8*a* in order to derive the transmitted downmix signal from the encoder downmix signal as generated, for example, by the block SAOC encoder in FIG. 5, SAOC encoder in FIG. 7 or SAOC encoder in FIG. 8*a*.

Then, the output signal modifier 120 is configured to apply the loudness optimization or the equalization or the multiband equalization or the dynamic range compression or the limiting operation again to the output signals generated by the object renderer 118 to finally obtain the modified output signals 160.

Furthermore, the object renderer 118 can be configured to calculate the output signals as channel signals for loudspeakers of a reproduction layout from the modified downmix signal, the parametric data 114 and position information 121 which can, for example, be input into the object renderer 118 via a user input interface 122 or which can, additionally, be transmitted from the encoder to the decoder separately or within the encoded signal 100, for example, as a "rendering matrix".

Then, the output signal modifier 120 is configured to apply the output signal modification function to these channel signals for the loudspeakers and the modified output signals 116 can then directly be forwarded to the loudspeakers.

In a different embodiment, the object renderer is configured to perform a two-step processing, i.e., to first of all reconstruct the individual objects and to then distribute the object signals to the corresponding loudspeaker signals by any one of the well-known means such as vector based amplitude panning or so. Then, the output signal 120 can also be configured to apply the output signal modification to the reconstructed object signals before a distribution into the individual loudspeakers takes place. Thus, the output signals generated by the object renderer 118 in FIG. 1 can either be reconstructed object signals or can already be (non-modified) loudspeaker channel signals.

Furthermore, the input signal interface 110 is configured to receive an enhanced audio object and regular audio objects as, for example, known from SAOC. In particular, an enhanced audio object is, as known in the art, a waveform difference between an original object and a reconstructed version of this object using parametric data such as the parametric data 114. This allows that individual objects such as, for example, four objects in a set of, for example, twenty objects or so can be transmitted very well, naturally at the price of an additional bitrate due to the information that may be used for the enhanced audio. Then, the object renderer 118 is configured to use the regular objects and the enhanced audio object to calculate the output signals.

In a further embodiment, the object renderer is configured to receive a user input 123 for manipulating one or more objects such as for manipulating a foreground object FGO or a background object BGO or both and then the object renderer 118 is configured to manipulate the one or more objects as determined by the user input when rendering the output signals. In this embodiment, it is advantageous to actually reconstruct the object signals and to then manipulate a foreground object signal or to attenuate a background object signal and then the distribution to the channels takes place and then the channel signals are modified. However, alternatively the output signals can already be the individual object signals and the distribution of the object signals after having been modified by block 120 takes place before distributing the object signals to the individual channel signals using the position information 121 and any well-known process for generating loudspeaker channel signals from object signals such as vector based amplitude panning.

Figure 2:
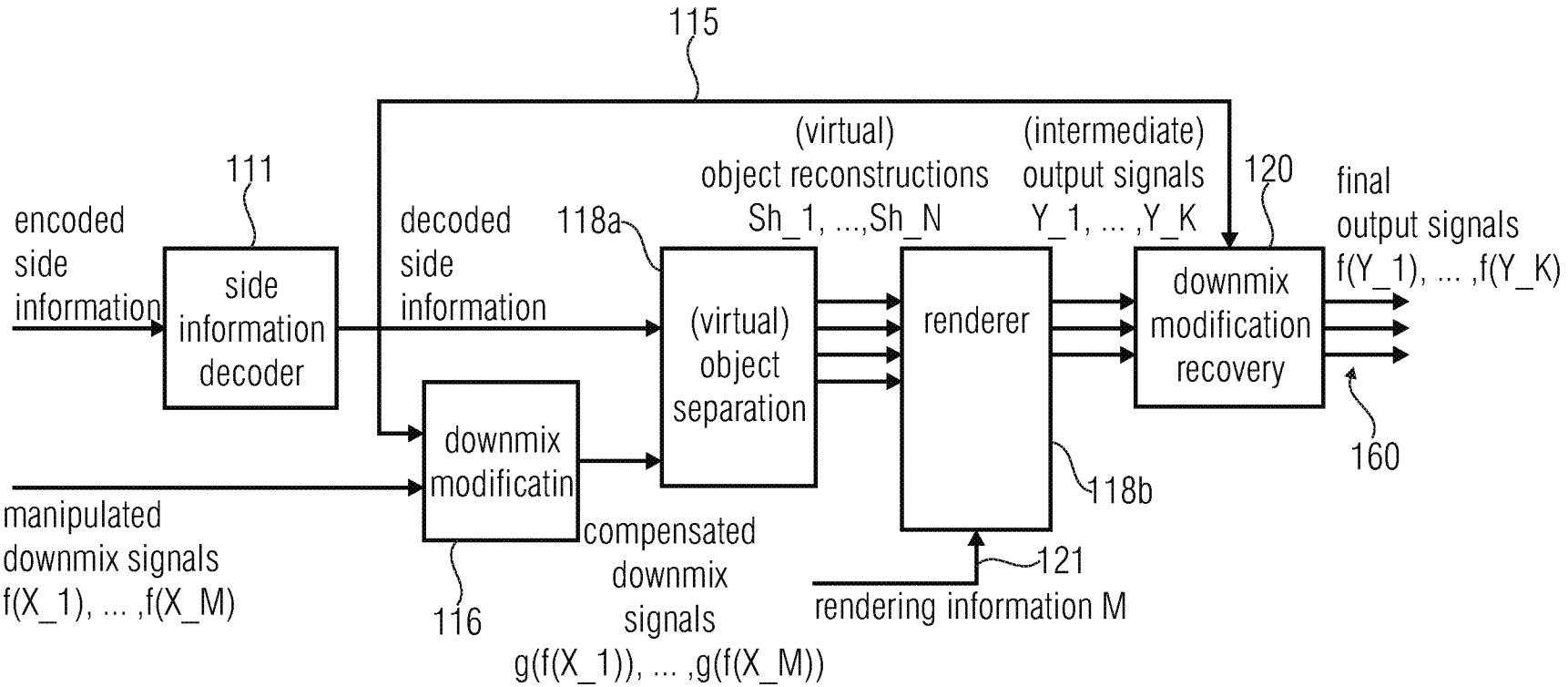
FIG. 2 is a further embodiment of the audio decoder.

Subsequently, FIG. 2 is described, which is an advantageous embodiment of the apparatus for decoding an encoded audio signal. Encoded side information is received which comprises, for example, the parametric data 114 of FIG. 1 and the modification information 115. Furthermore, the modified downmix signals are received which correspond to the transmitted downmix signal 112. It can be seen from FIG. 2 that the transmitted downmix signal can be a single channel or several channels such as M channels, where M is an integer. The FIG. 2 embodiment comprises a side information decoder 111 for decoding side information in the case in which the side information is encoded. Then, the decoded side information is forwarded to a downmix modification block corresponding to the downmix modifier 116 in FIG. 1. Then, the compensated downmix signals are forwarded to the object renderer 118 which consists, in the FIG. 2 embodiment, of a (virtual) object separation block 118*a* and a renderer block 118*b* which receives the rendering information M corresponding to the position information for objects 121 in FIG. 1. Furthermore, the renderer 118*b* generates output signals or, as they are named in FIG. 2, intermediate output signals and the downmix modification recovery block 120 corresponds to the output signal modifier 120 in FIG. 1. The final output signals generated by the downmix modification recovery block 160 correspond to the modified output signals in the terms of FIG. 1.

Advantageous embodiments use the already included side information of the downmix modification and inverse the modification process after the rendering of the output signals.

The block diagram of this is illustrated in FIG. 2. Comparing this to FIG. 8*b* one can note that the addition of the block "Downmix modification recovery" in FIG. 2 or output signal modifier in FIG. 1 implements this embodiment.

The encoder-created downmix signal X is manipulated (or the manipulation can be approximated as) with the function $f(X)$. The encoder includes the information regarding this function to the side information to be transmitted and/or stored. The decoder receives the side information and inverts it to obtain a modification or compensation function. (In MPEG SAOC, the encoder does the inversion and transmits the inverted values.) The decoder applies the compensation function on the downmix signals received $g(f(X))\approx f^{-1}(f(X))=X$ and obtains compensated downmix signals to be used in the (virtual) object separation. Based on the rendering information (from the user) M, the output scene is reconstructed from the (virtual) object reconstructions $\hat{S}$ by $Y=M\hat{S}$. It is possible to include further processing steps, such as the modification of the covariance properties of the output signals with the assistance of decorrelators. Such processing, however does not change the fact that the target of the rendering step is to obtain an output that approximates the result from applying the rendering process on the original input audio objects, i.e., $M\hat{S}\approx M\hat{S}$. The proposed addition is to apply the inverse of the compensation function $h(\bullet)=g^{-1}(\bullet)\approx f(\bullet)$ on the rendered output to obtain the final output signals $f(Y)$ with an effect approximating the downmix manipulation function $f(\bullet)$.

Subsequently, FIG. 3 is considered in order to indicate an advantageous embodiment for calculating the output signal modification function from the downmix signal modification function, and particularly in this situation where both functions are represented by corresponding gain factors for frequency bands and/or time frames.

The side information regarding the downmix signal modification in the SAOC framework [SAOC] are limited to gain factors for each downmix signal, as earlier described. In other words, in SAOC, the inverted compensation function is transmitted, and the compensated downmix signals can be obtained as illustrated in the first equation of FIG. 3.

Using this definition for the compensation function g(•), it is possible to define the inverse of the compensation function as $h(X)=g^{-1}(X)=W_{PDG}^{-1}X\approx f(X)$. In the case of the definition of g(•) from above, this can be expressed as the second equation in FIG. 3. If there exists the possibility that one or more of the compensation parameters $PDG_i$ are zero, some pre-cautions should be taken to avoid arithmetic problems. This can be done, e.g., by adding a small constant ε (e.g., $\varepsilon=10^{-3}$) to each (non-negative) entry as outlined in the third equation of FIG. 3, or by taking the maximum of the compensation parameter and a small constant as outlined in the fourth equation of FIG. 3. Also other ways exist for determining the value of $W_{PDG}^{-1}$.

Considering the transport of the information that may be used for re-applying the downmix manipulation on the rendered output, no additional information is required, if the compensation parameters (in MPEG SAOC, PDGs) are already transmitted. For added functionality, it is also possible to add signaling to the bitstream if the downmix manipulation recovery should be applied. In the context of MPEG SAOC, this can be accomplished by the following bitstream syntax:

| | | |
|---|---|---|
| bsPdgFlag; | 1 | uimsbf |
| if (bsPdgFlag) { | | |
| bsPdgInvFlag; | 1 | uimsbf |
| } | | |

When the bitstream variable bsPdgInvFlag 117 is set to the value 0 or omitted, and the bitstream variable bsPdgFlag is set to the value 1, the decoder operates as specified in the MPEG standard [SAOC], i.e., the compensation is applied on the downmix signals received by the decoder before the (virtual) object separation. When the bitstream variable bsPdgInvFlag is set to the value 1, the downmix signals are processed as earlier, and the rendered output will be processed by the proposed method approximating the downmix manipulation.

Figure 4:
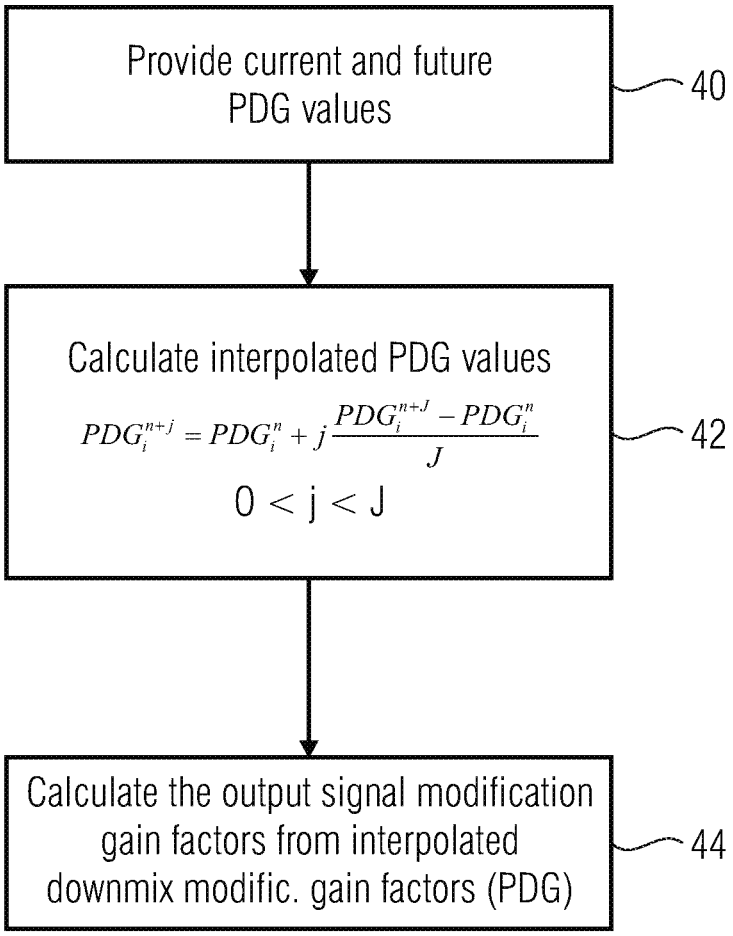
FIG. 4 illustrates a process for calculating output signal modification gain factors from interpolated downmix modification gain factors.

Subsequently, FIG. 4 is considered illustrating an advantageous embodiment for using interpolated downmix modification gain factors, which are also indicated as "PDG" in FIG. 4 and in this specification. The first step comprises the provision of current and future or previous and current PDG values, such as a PDG value of the current time instant and a PDG value of the next (future) time instant as indicated at 40. In step 42, the interpolated PDG values are calculated and used in the downmix modifier 116. Then, in step 44, the output signal modification gain factors are derived from the interpolated gain factors generated by block 42 and then the calculated output signal modification gain factors are used within the output signal modifier 120. Thus, it becomes clear that depending on which downmix signal modification factors considered, the output signal modification gain factors are not fully inverse to the transmitted factors but are only partly or fully inversed to the interpolated gain factors.

The PDG-processing is specified in the MPEG SAOC standard [SAOC] to take place in parametric frames. This would suggest that the compensation multiplication takes place in each frame using constant parameter values. In the case the parameter values change considerably between consecutive frames, this may lead into undesired artifacts. Therefore, it would be advisable to include parameter smoothing before applying them on the signals. The smoothing can take place in various methods, such as low-pass filtering the parameter values over time, or interpolating the parameter values between consecutive frames. An advantageous embodiment includes linear interpolation between parameter frames. Let $PDG_i^n$ be the parameter value for the ith downmix signal at the time instant n, and $PDG_i^{n+J}$ be the parameter value for the same downmix channel at the time instant n+J. The interpolated parameter values at the time instants n+j, 0<j<J can be obtained from the equation $$PDG_i^{n+j} = PDG_i^n + j\frac{PDG_i^{n+J} - PDG_i^n}{J}.$$

When such an interpolation is used, the inverted values for the recovery of the downmix modification should be obtained from the interpolated values, i.e., calculating the matrix $W_{PDG}^{n+j}$ for each intermediate time instant and inverting each of them afterwards to obtain $(W_{PDG}^{n+j})^{-1}$ that can be applied on the intermediate output Y.

The embodiments solve the problem that arises when manipulations are applied to the SAOC downmix signals. State-of-the-art approaches would either provide a sub-optimal perceptual quality in terms of object separation if no compensation for the mastering is done, or will lose the benefits of the mastering if there is compensation for the mastering. This is especially problematic if the mastering effect represents something that would be beneficial to retain in the final output, e.g., loudness optimizations, equalizing, etc. The main benefits of the proposed method include, but are not restricted to:

The core SAOC processing, i.e., (virtual) object separation, can operate on downmix signals that approximate the original encoder-created downmix signals closer than the downmix signals received by the decoder. This minimizes the artifacts from the SAOC processing.

The downmix manipulation ("mastering effect") will be retained in the final output at least in an approximate form. When the rendering information is identical to the downmixing information, the final output will approximate the default downmix signals very closely if not identically.

Because the downmix signals resemble the encoder-created downmix signals more closely, it is possible to use the enhanced quality mode for the objects, i.e., including the waveform correction signals for the EAOs.

When EAOs are used and the close approximations of the original input audio objects are reconstructed, the proposed method applies the "mastering effect" also on them.

The proposed method does not require any additional side information to be transmitted if the PDG side information of the MPEG SAOC is already transmitted.

If wanted, the proposed method can be implemented as a tool that can be enabled or disabled by the end-user, or by side information sent from the encoder.

The proposed method is computationally very light in comparison to the (virtual) object separation in SAOC.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[BCC] C. Faller and F. Baumgarte, "Binaural Cue Coding—Part II: Schemes and applications," IEEE Trans. on Speech and Audio Proc., vol. 11, no. 6, November 2003.

[JSC] C. Faller, "Parametric Joint-Coding of Audio Sources", 120th AES Convention, Paris, 2006.

[ISS1] M. Parvaix and L. Girin: "Informed Source Separation of underdetermined instantaneous Stereo Mixtures using Source Index Embedding", IEEE ICASSP, 2010.

[ISS2] M. Parvaix, L. Girin, J.-M. Brossier: "A watermarking-based method for informed source separation of audio signals with a single sensor", IEEE Transactions on Audio, Speech and Language Processing, 2010.

[ISS3] A. Liutkus and J. Pinel and R. Badeau and L. Girin and G. Richard: "Informed source separation through spectrogram coding and data embedding", Signal Processing Journal, 2011.

[ISS4] A. Ozerov, A. Liutkus, R. Badeau, G. Richard: "Informed source separation: source coding meets source separation", IEEE Workshop on Applications of Signal Processing to Audio and Acoustics, 2011.

[ISS5] S. Zhang and L. Girin: "An Informed Source Separation System for Speech Signals", INTERSPEECH, 2011.

[ISS6] L. Girin and J. Pinel: "Informed Audio Source Separation from Compressed Linear Stereo Mixtures", AES 42nd International Conference: Semantic Audio, 2011.

[PDG] J. Seo, S. Beack, K. Kang, J. W. Hong, J. Kim, C. Ahn, K. Kim, and M. Hahn, "Multi-object audio encoding and decoding apparatus supporting post downmix signal", United States Patent Application Publication US2011/0166867, July 2011.

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007.

[SAOC2] J. Engdeård, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008.

[SAOC] ISO/IEC, "MPEG audio technologies—Part 2: Spatial Audio Object Coding (SAOC)," ISO/IEC JTC1/SC29/WG11 (MPEG) International Standard 23003-2.

The invention claimed is:

1. Apparatus for decoding an encoded audio signal to acquire modified output signals, comprising:

an input interface configured for receiving the encoded audio signal, the encoded audio signal comprising a transmitted downmix signal and parametric data relating to audio objects comprised by the transmitted downmix signal, the transmitted downmix signal being different, due to a mastering step, from an encoder downmix signal, to which the parametric data is related;

a downmix modifier configured for modifying the transmitted downmix signal using a downmix modification function, wherein the downmix modification function is such that a modified downmix signal is identical to the encoder downmix signal or is more similar to the encoder downmix signal compared to the transmitted downmix signal, wherein the downmix modification function is so that an object separation obtained by an object renderer using the modified downmix signal and the parametric data is improved compared to an object separation that would be obtained by the object renderer using the transmitted downmix signal and the parametric data, and wherein the downmix modification function comprises applying downmix modification gain factors to different time frames or frequency bands of the transmitted downmix signal;

the object renderer configured for rendering the audio objects using position information for the audio objects, the modified downmix signal and the parametric data to acquire output signals; and an output signal modifier configured for modifying the output signals acquired by the object renderer using an output signal modification function, wherein the output signal modification function is such that a manipulation operation applied to the encoder downmix signal to acquire the transmitted downmix signal is at least partly applied to the output signals to acquire the modified output signals, wherein an influence of the mastering step is introduced into the modified output signals, and wherein the output signal modification function comprises applying output signal modification gain factors to different time frames or frequency bands of the output signals, wherein the input interface is configured to additionally receive information on the downmix modification gain factors, and wherein the output signal modifier is configured to derive the output signal modification gain factors from inverse values of the downmix modification gain factors, or wherein the input interface is configured to additionally receive information on the output signal modification gain factors, and wherein the downmix modifier is configured to derive the downmix modification gain factors from inverse values of the output signal modification gain factors.

2. Apparatus of claim 1, wherein the output signal modifier is configured for calculating the output signal modification factors by using a maximum of an inverted downmix modification gain factor and a constant value or by using a sum of the inverted downmix modification gain factor and the constant value, or wherein the downmix modifier is configured to apply interpolated downmix modification gain factors, and wherein the output signal modifier is configured for calculating the output signal modification factors by using a maximum of an inverted interpolated downmix modification gain factor and a constant value or by using a sum of the inverted interpolated downmix modification gain factor and the constant value, or wherein the downmix modifier is configured to apply smoothed downmix modification gain factors, and wherein the output signal modifier is configured for calculating the output signal modification factors by using a maximum of an inverted smoothed downmix modification gain factor and a constant value or by using a sum of the inverted smoothed downmix modification gain factor and the constant value, respectively.

3. Apparatus in accordance with claim 1, in which the output signal modifier is controllable by a control signal, wherein the input interface is configured for receiving a control information for the time frames of the frequency bands of the transmitted downmix signal, and wherein the output signal modifier is configured to derive the control signal from the control information.

4. Apparatus of claim 3, wherein the control information is a flag and wherein the control signal is so that the output signal modifier is deactivated, if the flag is in a set state, and wherein the output signal modifier is activated, when the flag is in a non-set state or vice versa.

5. Apparatus in accordance with claim 1, wherein the downmix modifier is configured to reduce or cancel a loudness optimization, an equalization operation, a multiband equalization operation, a dynamic range compression operation or a limiting operation, applied to the transmitted downmix signal, and wherein the output signal modifier is configured to apply the loudness optimization or the equalization operation or the multiband equalization operation or the dynamic range compression or the limiting operation to the output signals.

6. Apparatus in accordance with claim 1, wherein the object renderer is configured for calculating channel signals from the modified downmix signal, the parametric data and the position information indicating a positioning of the objects in a reproduction layout, the position information received via the input interface.

7. Apparatus of claim 1, wherein the object renderer is configured to reconstruct the audio objects using the parametric data and to distribute the audio objects to channel signals for a reproduction layout using the position information indicating a positioning of the audio objects in a reproduction layout, the position information received via the input interface.

8. Apparatus in accordance with claim 1, wherein the input interface is configured to receive an enhanced audio object being a waveform difference between an original audio object and a reconstructed audio object, wherein a reconstruction for reconstructing the reconstructed audio object was based on the parametric data, and a regular audio object corresponding to an original audio object, wherein the object renderer is configured to use the regular audio object and the enhanced audio object to calculate the output signals.

9. Apparatus in accordance with claim 1, in which the object renderer is configured to receive a user input for manipulating one or more audio objects and in which the object renderer is configured to manipulate the one or more audio objects as determined by the user input when rendering the output signals.

10. Apparatus of claim 9, wherein the object renderer is configured to manipulate the foreground audio object or a background audio object comprised by the encoded audio object signals.

11. Method of decoding an encoded audio signal to acquire modified output signals, comprising:

receiving a transmitted downmix signal and parametric data relating to audio objects comprised by the transmitted downmix signal, the transmitted downmix signal being different, due to a mastering step, from an encoder downmix signal, to which the parametric data is related;

modifying the transmitted downmix signal using a downmix modification function, wherein the downmix modification function is such that a modified downmix signal is identical to the encoder downmix signal or is more similar to the encoder downmix signal compared to the transmitted downmix signal, wherein the downmix modification function is so that an object separation obtained by a rendering using the modified downmix signal and the parametric data is improved compared to an object separation that would be obtained by the rendering using the transmitted downmix signal and the parametric data, and wherein the downmix modification function comprises applying downmix modification gain factors to different time frames or frequency bands of the transmitted downmix signal;

rendering the audio objects using position information for the audio objects, the modified downmix signal and the parametric data to acquire output signals; and modifying the output signals acquired by the rendering using an output signal modification function, wherein the output signal modification function is such that a manipulation operation applied to the encoder downmix signal to acquire the transmitted downmix signal is at least partly applied to the output signals to acquire the modified output signals, wherein an influence of the mastering step is introduced into the modified output signals, wherein the output signal modification function comprises applying output signal modification gain factors to different time frames or frequency bands of the output signals, wherein the receiving comprises receiving information on the downmix modification gain factors, and wherein the modifying comprises deriving the output signal modification gain factors from inverse values of the downmix modification gain factors, or wherein the receiving comprises receiving information on the output signal modification gain factors, and wherein the modifying comprises deriving the downmix modification gain factors from inverse values of the output signal modification gain factors.

12. Non-transitory digital storage medium having stored thereon a computer program for performing a method of claim 11, when said computer program is run by a computer or a processor.

* * * * *